United States Patent [19]

Pfeffer

[11] Patent Number: 4,878,482

[45] Date of Patent: Nov. 7, 1989

[54] INSULATED FLUID STORAGE UNIT AND METHOD OF MAKING

[75] Inventor: John D. Pfeffer, Brookfield, Wis.

[73] Assignee: A. O. Smith Corporation, Milwaukee, Wis.

[21] Appl. No.: 181,971

[22] Filed: Apr. 15, 1988

Related U.S. Application Data

[63] Continuation-in-part of Ser. No. 28,475, Mar. 20, 1987.

[51] Int. Cl.[4] ..... F24H 7/00

[52] U.S. Cl. ..... 126/375; 126/361; 220/444; 264/46.5; 264/46.9; 29/451

[58] Field of Search ..... 125/1 F, 144, 147, 151, 125/361, 362, 363, 375, 390, 437; 264/46.5, 46.6, 46.7, 46.9; 122/13 R, 13 A, 114, 119; 220/444, 902; 29/451, 455.1, 460

[56] References Cited

U.S. PATENT DOCUMENTS

| | | | |
|---|---|---|---|
| 4,372,028 | 2/1983 | Clark et al. | 29/460 |
| 4,447,377 | 5/1984 | Denton | 264/45.2 |
| 4,477,399 | 10/1984 | Tilton | 264/45.2 |
| 4,527,543 | 7/1985 | Denton | 126/361 |
| 4,736,509 | 4/1988 | Nelson | 126/375 |

*Primary Examiner*—Noah P. Kamen

*Attorney, Agent, or Firm*—Andrus, Sceales, Starke & Sawall

[57] ABSTRACT

A hot water storage unit includes an outer decorative shell with a hardened foam insulation within a cavity therebetween. A prefabricated bottom wall is secured between the opposed sidewalls of the tank and shell. The bottom wall is secured just above the temperature sensing and drain connectors of the storage tank with the top connections protected by a fiberglass covers. A top shell cover includes an air foam insulation injection hole. The bottom wall is a stable supporting body member having an outer sealing portion which is integrally formed with the body member or which is a separate element affixed to the body member to form an extension of the body member. The outer sealing portion has sufficient compression or deflection to produce a seal in response to positioning the shell about the tank. The insulation is introduced as a liquid which expands to form the insulation, with the bottom wall preventing the liquid insulation from passing downwardly of the dam. The bottom wall is shown as a single piece styrofoam body member slightly smaller than the width of the cavity with an outer polyurethane seal element secured to the outer wall of the body member. The styrofoam element or body member has radial slits to permit wrapping about the tank and has abutting ends, and is attached to the tank by an adhesive.

24 Claims, 2 Drawing Sheets

INSULATED FLUID STORAGE UNIT AND METHOD OF MAKING

BACKGROUND OF THE PRESENT INVENTION

This is a continuation-in-part of my application entitled "Insulated Fluid Storage Unit And Method Of Fabrication", U. S. Ser. No. 07/028,475 and filed Mar. 20, 1987.

This invention relates to an insulated fluid storage unit and particularly a hot water heater unit and to the method of fabrication of such unit, and in particular to a tank type hot water heater unit having an outer cast insulation within an outer shell.

Hot water heaters for domestic and other applications generally include an inner storage tank having an associated heating unit for heating of the water in the storage tank. The tank is enclosed within suitable insulation to retain the heat and minimize the necessity for frequent reheating. An outer esthetically pleasing shell or housing is generally provided to enclose the insulation.

A highly satisfactory insulating material is expanded foamed polyurethane. The insulation can be applied in a fluid or semi-fluid state and foamed to produce a rigid and closely adhering insulating enclosure about the inner tank. The present inventor's previous application as identified above disclosed a particularly satisfactory hot water heater in which the storage tank is insulated with a foamed insulation with a gas burner located within a firing chamber at the bottom of the storage tank for heating of the water within the storage tank. The firing chamber is secured extending downwardly from the bottom of the storage tank, generally with encircling insulation about the gas firing chamber. Electric heating units encircling the sidewall of the storage tank and electrically energized for heating of the water may be used in place of the gas fired burner.

Other typical systems, as set forth in my copending application, for inserting a foamed insulation using an inflatable confining bag are shown for example in U. S. Pat. No. 4,372,028, issued Feb. 8, 1983, entitled "Method Of Manufacturing Foam Insulated Tank", and U. S. Pat. No. 4,477,399, issued Oct. 16, 1984, entitled "Method And Apparatus For Manufacturing A Foam Insulated Water Heater". An alternative method of applying a foamed insulation uses an envelope inserted between the storage tank and the outer shell. The envelope is a plastic bag having a bottom wall and sidewalls engaging the outer shell and the storage tank. The inner bag wall which abuts the inner tank structure may extend only partially upwardly along the tank wall. The foam insulated material is then introduced into the envelope and expands within the envelope to fill the voids therein and produces the insulating jacket about the tank. An envelope type structure is shown in U. S. Pat. No. 4,447,377, issued May 8, 1984, and entitled "Method Of Insulating The Exterior Of A Water Heater Tank". A similar disclosure appears in U.S. Pat. 4,527,543, issued July 9, 1985, and entitled "Water Heater Construction".

Although the prior art foamed insulation systems for hot water heaters thus have been suggested and even used in commercial applications, the requirement of the special inflatable structures and/or envelope type devices require careful attention and 30 application, and may materially add to the cost of the heater structure and the fabrication of the heater.

Generally in accordance with the disclosure of the above application, a dam wall is formed between the tank wall and shell in the form of an encircling fiberglass or similar high temperature insulating fibrous belt which is affixed between the opposed sidewalls of the tank and shell. In assembly, the fiberglass belt is compressed and is secured within the cavity to form a sealed bottom wall to receive the expanding insulation into the cavity. In the illustrated embodiments, a fiberglass belt is wrapped about the inner storage tank and secured in place by an encircling band member, after which the outer shell is placed over the banded tank. The fibrous belt has a diameter somewhat larger than the internal diameter of the shell, which deflects and compresses the fiberglass belt to establish the initial seal. The foam insulation may be buffered, or an initial layer laid onto the fiberglass belt with a relatively low pressure condition, eliminating the tendency to drive the foam insulation material past the belt.

Although the prior art and particularly the use of the fiberglass belt as the bottom cavity wall has found significant commercial acceptance, there is a continuing need and demand for methods and apparatus which can further minimize the cost of production such as by improved production, assembly and handling, reduced cost of material, and the like without loss of an effective sealed bottom cavity wall structure which prevents movement of the liquid insulation below or past the bottom cavity wall structure.

SUMMARY OF THE INVENTION

The present invention is particularly directed to a hot water heater or the like having an outer hardened insulation cast between the tank and outer shell with a special bottom cavity wall defining the insulating cavity. The cavity wall includes an essentially semi-rigid element abutting the tank and having an outer peripheral surface in pressure sealing engagement with the shell. The bottom cavity wall is a member of limited flexibility and compressibility to effect the necessary seal during the introduction of the insulation into the cavity. The bottom wall may be formed of a semi-rigid insulation such as a semi-rigid polystyrene plastic, styrofoam plastic or the like. The semi-rigid element is formed to the tank shape or is formed from a strip like member having appropriate severed portions to permit wrapping of the semi-rigid element about the tank. The semi-rigid element may be formed with sufficient compressibility and flexibility to seal directly against the shell or in a preferred construction is made with an outer diameter slightly less than that of the shell with a more flexible or compressible material secured to the outer surface and sealing by engaging the outer shell.

More particularly, the water heater is formed by attaching the bottom cavity wall at an appropriate level to the tank prior to assembly of the outer shell. The outer surface of the bottom cavity wall is formed with a tapered periphery to define an opening of a diameter slightly less than the inner diameter of the shell at the upper surface of the wall and tapering downwardly to a diameter somewhat greater than the diameter of the shell. The wall includes the semi-rigid support element of styrofoam or the like. The element is formed as a straight bar-like element with a plurality of longitudinally spaced slits extending inwardly from one surface, which is adapted to abutt the tank, throughout a substantial portion of the bar element. Each slit is preferably formed with a conical shape to define a slight free space. This provides for convenient wrapping of the element about the tank with the slitted wall in close abuttment with the tank and with essentially no through passageways in the bar element. The end faces of the bar element are shaped to provide direct abuttment when applied to encircling the tank. The wrapped element is conveniently adhesively bonded to the tank. When the combination of an outer flexible or compressible sealing member is affixed to semi-rigid element, it may be adhesively bonded to the semi-rigid element. After assembly of the semi-rigid bottom cavity wall, the shell is dropped downwardly over the bottom cavity wall, preferably using a guiding means such as an apron or the like as more fully disclosed in applicant's above entitled application filed on Mar. 20, 1987 with Ser. No. 07/028/475.

The semi-rigid element provides a convenient unit for production processing as well as a low cost structure. The unit is therefore particularly adapted to use in the mass production of hot water heaters and the like.

The present invention has been found to provide a less costly but reliable and practical method and system for applying insulation to and about a storage tank and particularly a hot water heater.

BRIEF DESCRIPTION OF DRAWING

The drawing furnished herewith illustrates a best mode presently contemplated by the inventor in carrying out the invention.

In the drawings.

DESCRIPTION OF THE ILLUSTRATED EMBODIMENT

Figure 1:
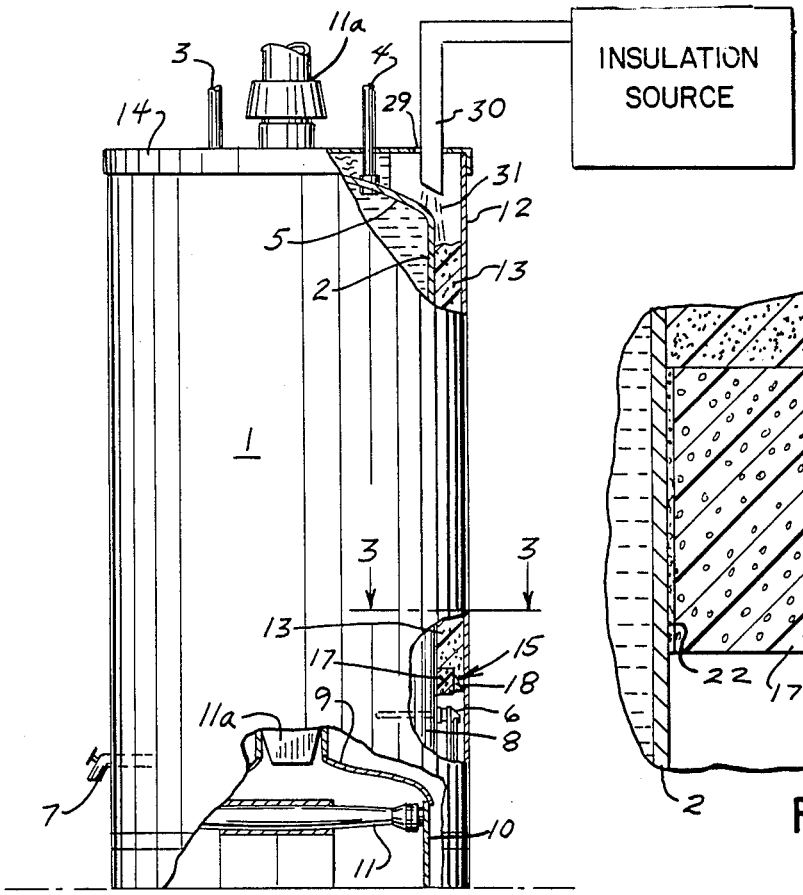
FIG. 1 is a side elevational view of a gas fired hot water heater with parts broken away and sectioned to show certain inner details of construction.

Referring to the drawings and particularly to FIG. 1, a gas fired hot water heater unit 1 is illustrated including an inner hot water storage tank 2 which is formed of a suitable metal and extends along an axis, shown in a vertical direction in FIG. 1. The tank 2 is essentially closed having water inlet and outer connections 3 and 4 at a domed top wall 5. A thermocouple connection 6 and a drain connection 7 are provided in the sidewall 8 of the tank 2. An integrated bottom extension 10 of the tank sidewall projects downwardly and defines a firebox or chamber within which a gas fired burner unit 11 is suitably mounted. The burner unit 11 is fired to heat the water within the tank 2 and provides a continuous source of heated water to the consumer. A flue duct 11*a* is mounted centrally of tank 2 and extends from the top wall 5.

An outer esthetically pleasing jacket or shell 12 formed of relatively thin metal or other suitable material is secured in outwardly spaced relation to the tank 2 and firebox extension 10. The shell 12 is mounted in spaced relation to the tank 2 by an insulation 13 which fills the space between the shell and the tank 2 and adheres to the respective surfaces. The insulation 13 extends upwardly over the top wall 5 of the tank 2. A shell cover 14 is secured to the top of shell 12 and maintains an esthetically pleasing outer enclosure of the cover and defines an upper space which is filled with insulation 13.

The insulation 13 is formed from an expanding material such as a foamable polyurethane which is cast in place directly within the cavity between the shell 12 and the storage tank 2 including the upper top shell cover 14. The insulation 13 extends downwardly about the storage tank 2 to a location immediately above the thermocouple connector 6. The lower end of the insulation 13 is defined by a separate encircling dam wall unit 15 which is compressed between the outer shell 12 and the storage tank 2. The dam wall unit 15 is a high temperature insulating element and holds the insulation 13 in spaced relation to the high temperature burner unit 11 and the firebox extension 10.

A conventional fiberglass insulation, not shown, may encircle the firebox extension 10 between the firebox and the lower end of the shell 12 in accordance with conventional practice.

The construction of the tank 2, gas burner unit 11, the outer shells 12 and 14 as well as the application of the insulation may be in accordance with well known and presently developed technology, and preferably as disclosed in the inventor's previous identified application. The present invention is particularly directed to an improvement in the formation and structure of the dam wall 15. The other components are therefore only described in such detail as necessary for a clear understanding of the present invention.

Figure 2:
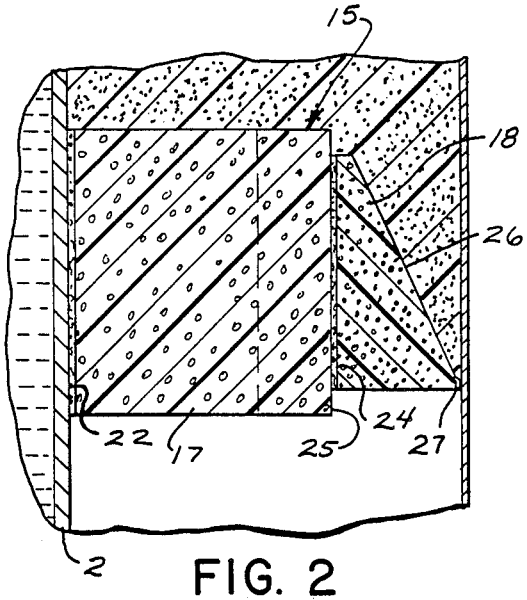
FIG. 2 is a fragmentary enlarged sectional view of the heater shown in FIG. 1.

In the illustrated embodiment of the invention, the dam wall unit 15 is a composite member, as shown in FIGS. 1 and 2, including an inner semi-rigid support element 17 affixed to the tank 2 and an outer flexible sealing element 18 in sealing engagement with the shell 12. The wall unit 15 is held to the tank 2 by any suitable structure and the insulation 13 is normally injected as a liquid under pressure The liquid may tend to move downwardly between interfaces between the wall unit 15 and the shell 12. The wall unit 15 is constructed and fabricated specially with the attachment to tank 2 and the compression of sealing element 18 minimizing such interface movement and positively preventing movement of the insulation downwardly into the area of the firebox where actual burning or scorching of the insulation might occur.

Figure 4:
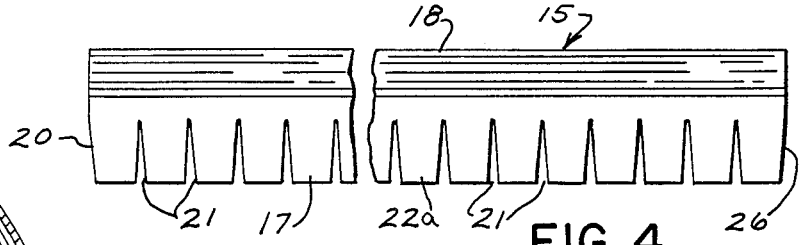
FIG. 4 is an elevational view of a dam wall element shown in FIGS. 1–3.
Figure 3:
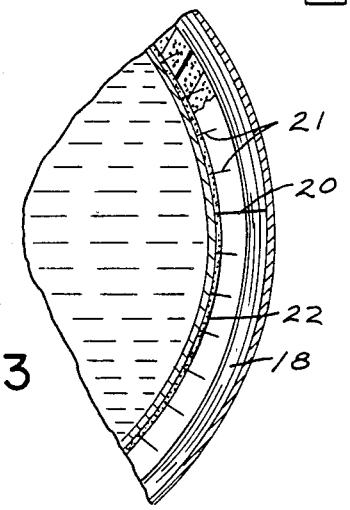
FIG. 3 is a fragmentary cross-sectional view taken generally on line 3—3 of FIG. 1.

More particularly, the illustrated bottom wall unit 15 of the cavity includes a integral essentially single piece wall support element 17, formed of a semi-rigid material such as a foamed styrofoam or other similar semi-rigid material having a limited compressibility and flexibility. The element 17, as illustrated, is formed as a single elongated member as shown in FIG. 4 of a length adapted to be wrapped about the tank 2 with the inner surface abutting the tank 2 and the ends 20 shaped to abutt and form a continuous essentially solid wall element. The rigidity of the element is such as to prevent normal wrapping about the tank. The element 17 is formed with a plurality of radial slits 21 extending from the tank-abutting inner wall 22*a* throughout a substantial depth of the element. As most clearly shown in FIG. 4, each slit 21 extends for approximately 75 per cent of the depth of the element 17. The slits 21 are formed with a slightly cone shaped configuration, as illustrated in FIG. 4, which close and permit wrapping of the element on the slitted surface into a circular configuration conforming to the tank wall and thus adapted to be wrapped about and in abutting engagement with the tank wall and with the opposed ends 20 located in abutting relation. The wrapping of the element 17 into a curved configuration closes the gaps defined by the slits 21 to form an essentially continuous wall. With the wall formed of a semi-rigid material such as styrofoam, the size of the slits 21 are not critical as the surface will give slightly. This permits tight wrapping of the element with slight compression of the element at the slitted surfaces or the like even if the slits are not large enough to accommodate the reduction in length and thereby establish a continuous essentially imperforate and closed bottom cavity wall encircling the tank.

The wrapped element 17 is secured to the tank wall in any suitable manner. In a preferred structure, a suitable adhesive 22 is secured to the inner wall of the element and when wrapped about the tank supports the element in sealing engagement on the tank wall. Alternatively, a simple clamping band, not shown, can be provided encircling the element and tightly securing the ends 20 of the element to each other with a pressure engagement to the wall of tank 2 to support the element in sealing engagement on the tank wall. Thus, the bottom wall element 17 must be supported during the assembly of the shell and introduction of the foam insulation. The slits 21 and ends 20 of the element 17 must be constructed such that in the final assembled relation, there is essentially no pass through openings defined at the respective locations in order to prevent the liquid foam from moving past the bottom wall unit.

The outer peripheral surface of the element 17 is placed in abutting and sealing engagement with the shell 12 as a result of the assembly of the shell over the tank 2 and wall unit 15. In order to faciliate assembly of the shell 12 over the element, the bottom wall element 17 is preferably formed with a top surface having a diameter somewhat less than the inner diameter of the shell. The gap defined by the bottom wall element 17 and the shell 12 is sealed by the flexible and/or compressible seal element 18. In the illustrated embodiment of the invention, the seal element 18 is shown as closed cell polyurethane. The element 18 is secured as by an adhesive 24 to the outer peripheral surface 25 of the semi-rigid bottom wall element 17.

The outer wall 26 of the sealing element 18 is inclined to form the inner bottom surface of the bottom wall element having a diameter which is less than the inner diameter of the shell 12. The inclined wall 26 projects outwardly and downwardly to a diameter greater than the inner diameter of the shell. During assembly, the shell 12 moves past the element 18, deflecting and compressing the seal element 18, as at 27 to form a liquid tight seal between the bottom wall unit 15 and the shell. Although the illustrated and described polyurethane seal element 18 has been found to provide a completely satisfactory construction, the seal element can of course be formed of any other suitable material. The seal element might be a simple deflecting rubber lip of a rubber-like material, a fiberglass belt or the like. The specific dimensions of sealing element 18 are not critical and the particular construction and material can readily be provided based on simple design analysis and/or simple experimentation as by using various materials and sized sealing elements.

The combination of a semi-rigid support element 17 and the small outer sealing element &8 provides a particularly simple and inexpensive but reliable bottom wall structure for the assembly and formation of the heater unit with the cast type insulation introduced into the cavity after assembly of the shell.

In fabrication, wall unit 15 is secured to the tank 2. An apron or guide, not shown, is draped over the tank 2 with opposite similar sidewall portions depending downwardly at least to cover the fiberglass belt, and preferably slightly below the wall unit 15, as disclosed in the inventor's previously identified copending application. The apron is a relatively thin, flexible member having substantially smooth surfaces, and functions as a guide for telescopinq of the outer shell 12 over the wall unit 15.

After placement of the shell 12, the upper end of the water connections 3 and 4 and the flue gas duct or tube 11*a* are sealed as by a fiberglass cover, not shown. Top shell cover 14 is assembled to the upper end of the outer shell 12 and includes an injection opening 29 through which a foam insulation injection nozzle 30 may be readily extended into the cavity between the tank and shell as shown in FIG. 1. A foamable insulation liquid, such a foamable polyurethane liquid, is injected from the nozzle under high pressure as at 31 into the cavity. The liquid expands into foamed insulation 13 and hardens into a solid insulating mass. The injection system is preferably constructed to minimize the pressure of the liquid applied to the wall unit 15, as more fully disclosed in the parent application of the inventor.

Figure 5:
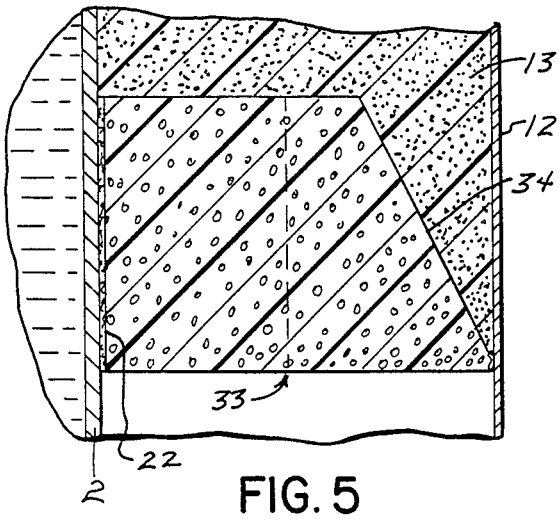
FIG. 5 is a view similar to FIG. 2 illustrating an alternate embodiment of the invention.

Although the bottom wall unit as constructed in FIGS. 1–4 provides a preferred construction, various modifications can readily be made to such structure. For example, as shown in FIG. 5, the bottom wall unit 15 can be formed as a single piece wall 33 secured to the wall of the tank 2 and projecting outwardly into sealing engagement with the shell 12. Single piece wall 33 is formed of a semi-rigid material such as polystryene, styrofoam or the like. In such a structure, the outer edge of the single piece wall member 33 is provided with an outer inclined peripheral wall 34 to guide the shell downwardly over the wall element. The diameter and construction of the wall element 33 of course is fairly critical in view of the limited compressibility of the wall material. Further, as a practical matter to assemble the unit, some form of a guide apron or the like overlying the outer wall of the bottom wall element, such as disclosed for example in applicant's copending application, would be used to facilitate the assembly.

Further, the bottom wall 33, or element 17 of the first embodiment, could be molded as an appropriate ring having an inner diameter adapted to be slipped downwardly over the tank and sealingly secured to the tank at the appropriate location.

Figure 6:
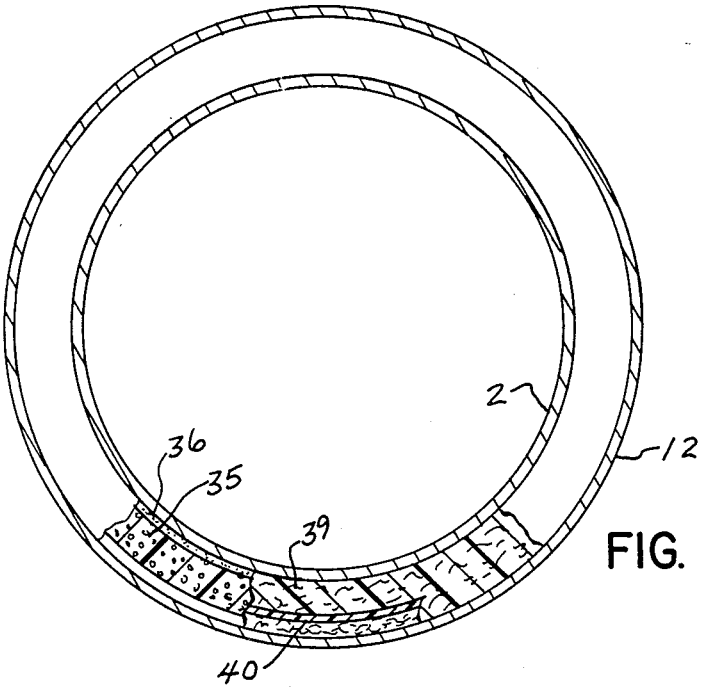
FIGS. 6–8 inclusive illustrate an alternate embodiment of the invention.

In certain larger water heater units, a more significant gap is encountered between the tank wall and the shell. The use of the styrofoam and sealing lip has not produced optimum sealing between the tank and the shell. A simple and more effective sealing assembly is illustrated in the further embodiment of the invention of FIGS. 6 through 8 inclusive.

Figure 7:
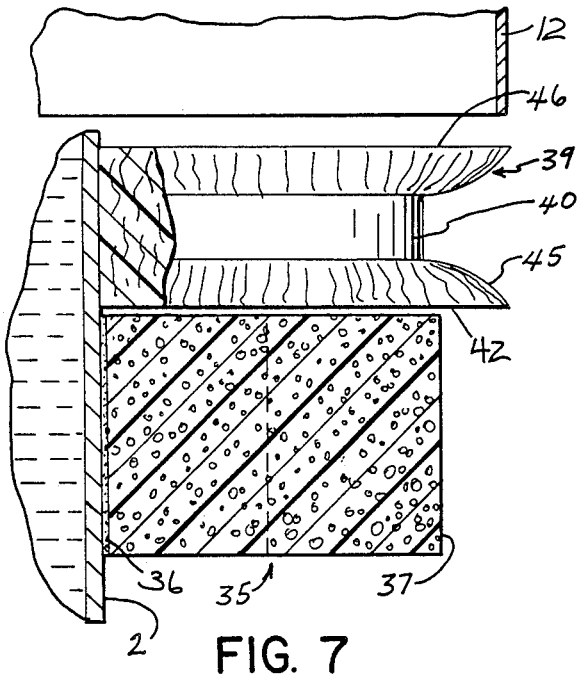
Figure 8:
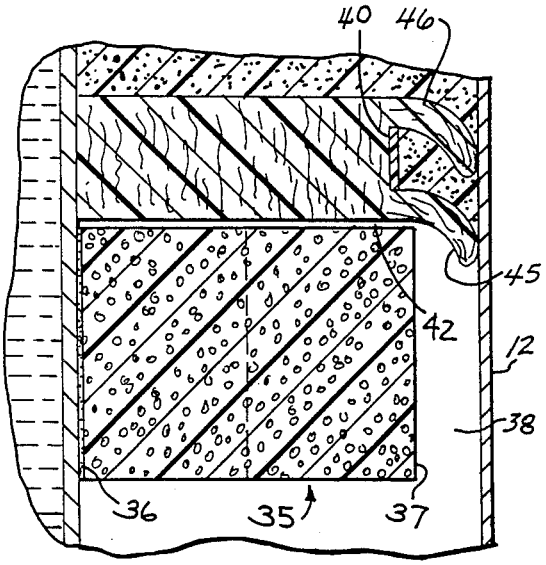

Referring particularly to this embodiment, a styrofoam block 35 to the tank wall as by an adhesive 36. The styrofoam block 35 is provided with a flat peripheral surface or face 37 and substantially fills the cavity width. A small gap 38 is formed between the outer face 37 of the foam block and the shell 12. A fiberglass belt 39 is secured to the tank wall as by a banding 40 or the like. The fiberglass belt 39 is preferably constructed as in the inventor's prior parent application and is a batted fiberglass having layers of fiberglass which are generally parallel to the tank wall. The fiberglass belt 39 is secured to the tank in slightly upwardly spaced relation to the styrofoam block 35, as at 42. The clamping band 40 encircles and clamps the belt to the tank with opposite outer ends flaring outwardly as shown in FIG. 7. The fiberglass belt 39 and particularly the flared end extends outwardly beyond the final location of the shell 12 which is to be moved downwardly over the tank and fiberglass belt.

Upon assembly of the outer shell 12, the flared ends of the fiberglass belt 39 are deflected downwardly. The lower flared portion of the belt 39 deflects downwardly into the gap 38, as at 45 in FIG. 8 and forms a closure of the small gap 38. In a practical construction, the spacing of the shell and water tank may be on the order of 6 inches. Gap 38 is practially formed on the order of ¼ of an inch. Upon introduction of the foam insulation 13, the material moves downwardly onto the belt, passing between the belt upper flared portion 46 and onto the flared portion 45. The deflected fiberglass portion 45 seals the gap 38 and supports the insulation between the styrofoam block 35 and the shell 12 while the styrofoam block 35 itself provides bottom wall. Thus, the combination of the styrofoam and the fiberglass belt provides a simple, convenient and effective method and means for sealing or forming of the bottom wall of the cavity.

The present invention is thus directed to providing of a bottom wall element comprising a prefabricated body member which is secured to the tank wall and effectively closes the bottom wall of the cavity between the tank and shell of a hot water heater or the like and in which the wall is an essentially rigid member having an outer sealing portion, either integrally formed with or separately secured to the prefabricated body member to effectively seal to the shell. Generally, the sealing portion can be constructed of a material which can operate under the high temperature conditions created by the water within the tank. In this aspect of the invention of course the semi-rigid bottom element could be secured to the shell with the flexible sealing element located between such bottom wall element and the tank during the assembly of the shell. The securement of the unit within the shell would not provide the convenience in mass production provided by attachment to the exterior of the tank as shown in the drawings, which therefore illustrates the preferred construction.

The present invention, with the semi-rigid support element defines a firm reliable stop in combination with a relatively small sealing area which produces an effective and reliable dam wall. The dam wall eliminates loss of the insulation material or movement of the insulation material from the cavity. Further, any small passage which may occur will be essentially at the flexible sealing wall structure. This of course is adjacent the outer shell and the cooler portion of the assembly to further minimize any adverse effect which might accidently inadvertently be created.

The present invention thus provides a significant improvement in the method and fabrication process of hot water heaters or the like in which a cavity is formed by relatively telescoped members separated by a hardened insulation introduced as a liquid medium. The present invention particularly provides an inexpensive but reliable system of trapping the expanding insulation in mass produced hot water heater units or the like at minimal cost.

Various modes of carrying out the invention are contemplated as being within the scope of the following claims particularly pointing out and distinctly claiming the subject matter which is regarded as the invention.

I claim:

1. A liquid heating unit, comprising an inner tank extending along an axis, an outer shell spaced from said storage tank and defining a cavity between said opposed walls of said shell and tank, a bottom wall secured in said cavity between said shell and storage tank to define the bottom end of said cavity, said bottom wall including an essentially semi-rigid single support element of a high temperature insulation and having an extended surface parallel to said axis of said tank, said extended surface directly affixed to and abutting the tank, and said support element having an outer peripheral surface sealed to said shell, and a hardened insulation filling said cavity and defining a rigid insulation about said inner tank.

2. The heating unit of claim 1 including an adhesive securing said semi-rigid element to said tank.

3. The heating unit of claim 2 wherein said peripheral surface is inclined to define an upper diameter slightly less than said shell and extended outwardly to a lower diameter slightly greater than said shell.

4. The heater unit of claim 1 wherein said semi-rigid element is styrofoam.

5. The heating unit of claim 1 wherein said semi-rigid element includes a plurality of inner radial slits with abutting walls with the element abutting the tank wall.

6. A hot water heater unit, comprising an inner hot water storage tank extending along an axis, an outer tubular shell secured in encircling spaced relation to said storage tank, a wall means of a high temperature insulation located between the shell and said storage tank adjacent the lower end of the storage tank, said wall means including an annular support element having an extended surface parallel to said axis of said tank and secured to said tank and having an exterior circumferential surface and an outer flexible element secured to the exterior circumferential surface of said support element, said flexible element being radially compressed between said support element and said shell to form a liquid tight seal to said shell, and said support element and said flexible element forming the bottom wall of an insulation cavity, and insulation filling the cavity defined by the storage tank and said shell above said wall means.

7. The hot water heater unit of claim 6 wherein said flexible element is formed of fiberglass.

8. The hot water heater unit of claim 6 wherein said flexible element is formed of a plastic.

9. The hot water heater unit of claim 6 wherein said support element is styrofoam having a radial depth substantially greater than said flexible element.

10. The heater unit of claim 9 having an adhesive interposed between the support element and the tank to secure the wall means to the tank.

11. A method of manufacturing a hot water heater unit having an inner tank and an intermediate expanded foam insulation and an outer shell spaced from said storage tank by said insulation, comprising securing a bottom wall to the tank including an elongated semi-rigid element of a high temperature insulation, said element having a length corresponding to the circumference of the tank wall, forming a plurality of slits in said element extending inwardly of the element, wrapping said element about the wall of said inner tank with slits extending outwardly of the tank, moving the outer shell over said element with said bottom wall means closing said cavity adjacent one end, and introducing an insulation material under pressure to fill the cavity defined by said internal tank, said bottom wall means and said outer shell.

12. The method of claim 11 wherein said semi-rigid element has an outer diameter less than said shell, and securing a sealing means between said semi-rigid element and said shell, said sealing means being deflected by the moving of said shell over the element.

13. The method of claim 11 including the step of forming said sealing means from a resilient compressible element, and adhesively bonding said sealing means to said semi-rigid element.

14. The method of claim 13 including the step of forming said compressible element with an outer peripheral inclined surface extending upwardly and inwardly from the lower surface of said bottom wall and forming an upper surface of said bottom wall.

15. A liquid heating unit, comprising an inner tank, an outer shell spaced from said storage tank and defining a cavity between said opposed walls of said shell and tank, a bottom wall secured in said cavity between said shell and storage tank to define the bottom end of said cavity, said bottom wall including an essentially semi-rigid single support element of a high temperature insulation directly affixed to and abutting the tank and having an outer peripheral surface, said support element is spaced from said shell to define a small gap between said support element and said shell and having a fibrous compressible belt member secured to the tank above said semi-rigid support element, said belt member having an outer peripheral portion overlying said gap and projecting into said gap to seal said peripheral surface to said shell and a hardened insulation filling said cavity and defining a rigid insulation about said inner tank and said insulation confined to said cavity by said support element and said belt member.

16. The heating unit of claim 15 wherein said belt member is formed of a high temperature fibrous material.

17. The heating unit of claim 16 wherein said belt member is a fiberglass belt of a generally multiple layer construction, clamp means secured to the outer central portion of the belt and clamping the belt to the tank, said belt having outer ends flared outwardly from said clamp means into engagement with the shell, and one of said flared ends being deflected downwardly into said gap.

18. A hot water heat unit, comprising an inner hot water storage tank, an outer tubular shell secured in encircling spaced relation to said storage tank, a dam wall means encircling said storage tank and radially compressed between said storage tank and said shell to form the bottom wall of a cavity with said shell and said tank, said wall means secured to said tank, and said wall means including an essentially rigid member secured to the tank wall and projecting outwardly and having an outer peripheral surface spaced from the shell to form a small gap, and a flexible sealing member secured within the cavity to seal said small gap and complete said bottom wall, and insulation filling the cavity defined by the storage tank and said shell above said wall means.

19. The hot water heater unit of claim 18 wherein said essentially rigid member is a styrofoam, and said flexible sealing member is a fiberglass belt.

20. The heater unit of claim 19 including a band encircling said belt and firmly clamping said belt to said tank wall, said belt being located in vertically spaced relation to said essentially rigid member.

21. A liquid heating unit, comprising an inner tank, an outer shell spaced from said storage tank and defining a cavity between said opposed walls of said shell and tank, a bottom wall secured in said cavity between said shell and storage tank to define the bottom end of said cavity, said bottom wall including an essentially semi-rigid single support element of a high temperature insulation directly affixed to and abutting the tank and having an outer peripheral surface sealed to said shell, and a hardened insulation filling said cavity and defining a rigid insulation about said inner tank including a compressible shield element between said support element and said shell to seal said outer peripheral surface to said shell.

22. A hot water heater unit, comprising an inner hot water storage tank, an outer tubular shell secured in encircling spaced relation to said storage tank, a dam well means encircling said storage tank and radially compressed between said storage tank and said shell to form the bottom wall of a cavity with said shell and said tank, said wall means secured to said tank, said wall means including an essentially rigid material having a limited flexibility and deflection, insulation filling the cavity defined by the storage tank and said shell above said well, said rigid material is a styrofoam material having a plurality of substantially radial slits extending from the surface abutting the tank to facilitate bending said rigid material and permitting firm engagement with the tank.

23. A hot water heater unit, comprising an inner hot water storage tank, an outer tubular shell secured in encircling spaced relation to said storage tank, a dam well means encircling said storage tank and radially compressed between said storage tank and said shell to form the bottom wall of a cavity with said shell and said tank, said wall means secured to said tank, said wall means including an essentially rigid material having a limited flexibility and deflection, insulation filling the cavity defined by the storage tank and said shell above said wall, a band encircle said wall means and firmly clamps said wall means to said storage tank.

24. A hot water heater unit, comprising an inner hot water storage tank, an outer tubular shell secured in encircling spaced relation to said storage tank, a dam wall means encircling said storage tank and radially compressed between said storage tank and said shell to form the bottom wall of a cavity with said shell and said tank, said wall means secured to said tank, said wall means including an essentially rigid material having a limited flexibility and deflection, insulation filling the cavity defined by the storage tank and said shell above said wall, said wall means includes a flexible material of a significantly greater deflection than said rigid material and located between said rigid material and said shell, and said flexible material being compressed between said tanks and said shell.

* * * * *